United States Patent [19]

Gilligan et al.

[11] 4,311,649

[45] Jan. 19, 1982

[54] N,N-BIS(2-FLUORO-2,2-DINITROETHYL)-CARBAMATE ESTERS

[75] Inventors: William H. Gilligan, Ft. Washington; Michael E. Sitzmann, Adelphi, both of Md.

[73] Assignee: The United States of America as represented by the Secretary of the Navy, Washington, D.C.

[21] Appl. No.: 210,981

[22] Filed: Nov. 28, 1980

[51] Int. Cl.[3] ..... C07C 155/02

[52] U.S. Cl. ..... 260/455 A

[58] Field of Search ..... 260/455 A

[56] References Cited

U.S. PATENT DOCUMENTS

| | | | |
|---|---|---|---|
| 3,836,524 | 9/1974 | Pitt | 260/455 A |
| 3,850,978 | 11/1973 | Gilligan et al. | 260/482 C |
| 4,001,291 | 3/1976 | Adolph | 260/455 R |

*Primary Examiner*—Henry R. Jiles
*Assistant Examiner*—Robert C. Whittenbaugh
*Attorney, Agent, or Firm*—R. S. Sciascia; A. L. Branning; R. D. Johnson

[57] ABSTRACT

N,N-Bis(2-fluoro-2,2-dinitroethyl) amine is reacted with methyl, ethyl, or n-propyl chlorothiolformate in the presence of titanium tetrachloride to give the intermediate S-methyl, S-ethyl or S-propyl N,N-bis(2-fluoro-2,2-dinitroethyl) thiocarbamate (II),

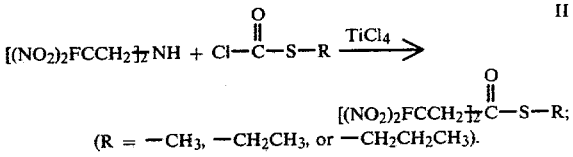

II

The thiocarbamate (II) is then refluxed with sulfuryl chloride to yield N,N-bis(2-fluoro-2,2-dinitroethyl) carbamyl chloride (I),

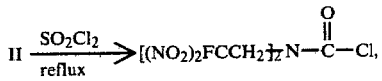

I which is useful as an explosive and as an intermediate for the synthesis of energetic explosive or propellant compounds.

4 Claims, No Drawings

N,N-BIS(2-FLUORO-2,2-DINITROETHYL)CARBAMATE ESTERS

BACKGROUND OF THE INVENTION

This invention relates to organic explosives and more particularly to fluoronitroorganic explosives.

A previous method for the preparation of N,N-bis(2-fluoro-2,2-dinitroethyl)carbamyl chloride (I) has been reported by W. H. Gilligan and M. J. Kamlet in U.S. Pat. No. 3,850,978, which issued on Nov. 26, 1974. However, that method suffers from the serious disadvantage that the carbamyl chloride (I) can not be separated from the reaction mixture and must be used in crude form for subsequent reactions. This drawback greatly hinders the preparation of derivatives of the carbamyl chloride (I) and heretofore certain derivatives of it could be prepared only in very low yield or not at all. For example, reaction of crude N,N-bis(2-fluoro-2,2-dinitroethyl)carbamyl chloride (prepared by the procedure of Gilligan and Kamlet, supra) with 2-fluoro-2,2-dinitroethyl amine gave none of the desired N,N,N'-tris(2-fluoro-2,2-dinitroethyl)urea. Less than a 5% yield of N,N-bis(2-fluoro-2,2-dinitroethyl)-O-(2,2,2-trinitroethyl)carbamate was obtain when the crude N,N-bis(2-fluoro-2,2-dinitroethyl)carbamyl chloride was reacted with 2,2,2-trinitroethanol.

SUMMARY OF THE INVENTION

Accordingly, an object of this is to provide an improved method of producing N,N-bis(2-fluoro-2,2-dinitroethyl)carbamyl chloride.

Another object of this invention is to provide a method of obtaining pure N,N-bis(2-fluoro-2,2-dinitroethyl)carbamyl chloride.

A further object of this invention is to provide new, more powerful explosive compounds having good thermal and chemical stabilities.

Yet another object of this invention is to provide novel compounds which are useful in high energy explosives.

Still a further object of this invention is to provide new compounds which are useful as intermediates for the synthesis of other explosive compounds.

These and other objects of this invention are accomplished by providing an improved method of producing N,N-bis(2-fluoro-2,2-dinitroethyl)carbamyl chloride comprising:

(1) reacting N,N-bis(2-fluoro-2,2-dinitroethyl)amine with an S-alkyl chlorothiolformate of the formula

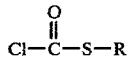

in the presence of titanium tetrachloride to produce a thiocarbamate of the formula

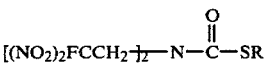

II wherein R is methyl, ethyl, or n-propyl.

(2) reacting the thiocarbamate with sulfuryl chloride to produce N,N-bis(2-fluoro-2,2-dinitroethyl)carbamyl chloride; and (3) isolating the product N,N-bis(2-fluoro-2,2-dinitroethyl)carbamyl chloride.

The pure N,N-bis(2-fluoro-2,2-dinitroethyl)carbamyl chloride is used to make N,N,N'-tris(2-fluoro-2,2-dinitroethyl)urea, N,N-bis(2-fluoro-2,2-dinitroethyl)-O-(2,2,2-trinitroethyl)carbamate, N,N-bis(2-fluoro-2,2-dinitroethyl)urea, [N,N-bis(2-fluoro-2,2-dinitroethyl)carbamyl]hydrazine, 1,2-di-[N,N-bis(2-fluoro-2,2-dinitroethyl)carbamyl]hydrazine, N,N,N',N'-tetrakis(2-fluoro-2,2-dinitroethyl)biuret, 1-[N,N-bis(2-fluoro-2,2-dinitroethyl)carbamyl]-2-(2-fluoro-2,2-dinitroethylimidoyl)hydrazine, 1-[N,N-bis(2-fluoro-2,2-dinitroethyl)carbamyl]-2-fluorodinitroacetyl hydrazine, and a mixture of 1-trifluoroacetyl-3-[bis(2-fluoro-2,2-dinitroethyl)amino]-5-fluorodinitromethyl-1,2,4-triazole, 2-trifluoroacetyl-3-[bis(2-fluro-2,2-dinitroethyl)amino]-5-fluorodinitromethyl-1,2,4-triazole, and 4-trifluoroacetyl-3-[bis(2-fluoro-2,2-dinitroethyl)amino]-5-fluorodinitromethyl-1,2,4-triazole. There compounds are useful as explosive materials.

DETAILED DESCRIPTION OF THE PREFERRED EMBODIMENT

N,N-bis(2-fluoro-2,2-dinitroethyl)amine is reacted with methyl, ethyl, or n-propyl chlorothiolformate in the presence of titanium tetrachloride to give the corresponding S-methyl, S-ethyl, or S-propyl N,N-bis(2-fluoro-2,2-dinitroethyl)thiocarbamate (II).

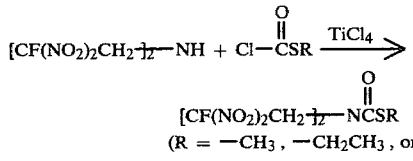

Care was taken to protect the reaction mixture from atmospheric moisture. Other reaction conditions are illustrated by example 1 below.

In step 2 of the process, the thiolcarbamate (II) is treated with sulfuryl chloride to give N,N-bis(2-fluoro-2,2-dinitroethyl)carbamyl chloride. As example 2 illustrates, this may be accomplished by refluxing the thiolcarbamate (II) with sulfuryl chloride in chloroform.

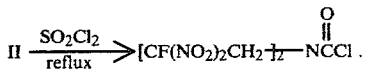

Example 2 further illustrates the conditions for this reaction.

Conventional factors such as boiling point, chemical inertness, and solubilities of the reactants were used in selecting the solvents. Chlorohydrocarbons such as chloroform, methylene chloride, and 1,2-dichloroethane are generally suitable for these reactions.

Examples 3 through 11 illustrate the wide variety of explosive compounds which can be synthesized from purified N,N-bis(2-fluoro-2,2-dinitroethyl)carbamyl chloride (I).

To more clearly illustrate this invention, the following examples are presented. It should be understood, however, that these examples are presented merely as a means of illustration and are not intended to limit the scope of the invention in any way.

EXAMPLE 1

Preparation of S-ethyl N,N-bis(2-fluoro-2,2-dinitroethyl)thiocarbamate (II)

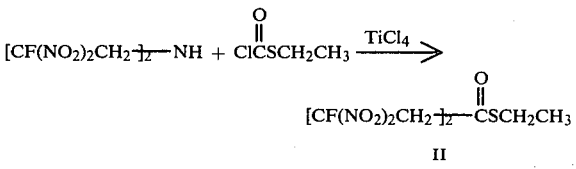

II

A mixture of 55.0 g (0.19 mol) of bis(2-fluoro-2,2-dinitroethyl)amine, 38 ml of chloroform, 40 ml of ethyl chlorothiolformate and 20 ml of titanium tetrachloride was heated in an oil bath at 65°–67° C. for 17 hours (The reaction mixture was protected from atmospheric moisture with a drierite drying tube). Chloroform (100 ml) was added to the warm mixture which was then filtered through celite. The dark colored filtrate was pulled on a rotary evaporator to give a residue which was dissolved in methanol and treated with charcoal. After filtration, the solvent was removed with a rotary evaporator and the product was crystallized by dissolving in chloroform (55 ml) and cooling in the freezer. The yield was 48.0 g (67%), mp 74°–75° C., NMR (chloroform): δ1.26(t), 2.95(q), 4.83(d).

Anal Calcd for $C_7H_9F_2N_5O_9S$: C, 22.29; H, 2.41; N, 18.57; F, 10.07; S, 8.50. Found: C, 22.19; H, 2.37; N, 18.23; F, 9.79, S, 8.32.

EXAMPLE 2

Preparation of N,N-bis(2-fluoro-2,2-dinitroethyl)carbamyl chloride (I)

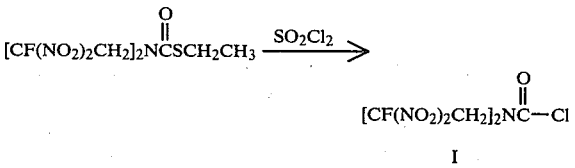

I

A mixture of 30.4 g of S-ethyl-N,N-bis(2-fluoro-2,2-dinitroethyl)thiolcarbamate, 125 ml of 1,2-dichloroethane and 60 ml of sulfuryl chloride was cautiously heated to the reflux point. After the initial vigorous gas evolution subsided the reaction mixture was maintained at reflux temperature for 8 hours. The volatiles were removed with a rotary evaporator to give an oily residue which was stirred with 2×340 ml of dry hexane. The hexane extracts were decanted from the insoluble oil which was then pulled dry and dissolved in 25 ml of warm chloroform. Cooling in the freezer gave 24.2 g (85%) of crystals, mp 45°–47° C. NMR (chloroform: δ4.97 (d). IR (KBr): 1745 (c=o), 1604 ($NO_2$) $cm^{-1}$.

Anal. Calcd $C_5H_4ClF_2N_5O_9$: C, 17.08; H, 1.15; Cl, 10.08; F, 10.81; N, 19.92. Found: C, 17.01; H, 1.15; Cl, 10.17; F, 10.89; N, 19.90.

The above method described in this invention yields I in pure crystalline form in contrast to the previously described procedure of Gilligan and Kamlet which does not allow I to be isolated from the reaction mixture. The use of pure I gives much better results with regard to yields and variety of explosive derivatives that can be prepared from I. For example, reaction of crude I (prepared by the procedure of Gilligan and Kamlet) with 2-fluoro-2,2-dinitroethyl amine gave none of the desired N,N,N'-tris(2-fluoro-2,-dinitroethyl)urea (III) whereas use of pure I from the above procedure resulted in a 45% yield of III. Less than a 5% yield of N,N-bis(2-fluoro-2,2-dinitroethyl)-O-(2,2,2-trinitroethyl)carbamate (IV) could be isolated from the reaction of crude I with 2,2,2-trinitroethanol, but pure I under similar conditions gave a 24% yield. Additional examples of explosives which were prepared directly from pure I include: N,N-bis(2-fluoro-2,2-dinitroethyl)urea (V), [N,N-bis(2-fluoro-2,2-dinitroethyl)carbamyl]hydrazine (VI), 1,2-di[N,N-bis(2-fluoro-2,2-dinitroethyl)carbamyl]hydrazine (VII) and N,N,N',N',tetrakis(2-fluoro-2,-dinitroethyl)biuret (VIII). Examples 3 through 8 illustrate the preparation of these derivatives.

EXAMPLE 3

Preparation of N,N,N'-tris(2-fluoro-2,2-dinitroethyl)urea (III)

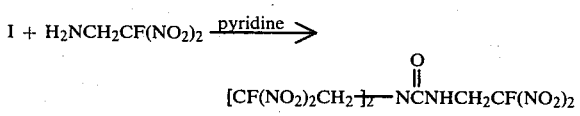

A solution of 3.5 g of 2-fluoro-2,2-dinitroethylamine in 20 ml of methylene chloride was stirred in an ice bath before 3 ml of pyridine was added. A solution of 7 g of N,N-bis(2-fluoro-2,2-dinitroethyl)carbamyl chloride in 18 ml of methylene chloride was added in 3 portions and stirring in the ice bath was continued for 30 minutes. The ice bath was removed and after 1.5 hours the methylene chloride reaction mixture was washed with dilute hydrochloric acid and then with water. The solvent was removed with a rotary evaporator to give a residue (12.3 g) which was stirred with 180 ml of boiling chloroform. The solution was treated with charcoal, filtered, and concentrated to 100 ml. Cooling in the freezer gave 4.22 g (45%) of crystals, mp 106°–110° C. Recrystallization from methylene chloride gave 3.35 g, mp 111°–113° C. NMR (acetone): δ4.76 (multiplet), 5.17 (d), 7.50 (broad t). IR (KBr): 3450 (NH), 1690 (c=o) $cm^{-1}$.

Anal. cald for $C_7H_7F_3N_8O_{13}$: C, 17.96; H, 1.51; F, 12.18; N, 23.94. Found: C, 18.03; H, 1.50; F, 11.82; N, 23.76.

EXAMPLE 4

Preparation of N,N-bis(2-fluoro-2,2-dinitroethyl)-O-(2,2,2-trinitroethyl)carbamate (IV)

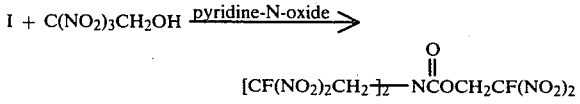

IV

A mixture of 3.5 g of N,N-bis(2-fluoro-2,2-dinitroethyl)carbamyl chloride was stirred in an ice bath while 4 ml of pyridine-N-oxide solution (2.6 M in methylene chloride) was added dropwise over a 10 minute period. Additional methylene chloride (30 ml) was added and the mixture was stirred in the ice bath for 30 minutes and then overnight at ambient temperature. The insoluble white solid was removed by filtration and the filtrate was pulled on a rotary evaporator to remove solvent.

The residue (4.3 g) was subjected to column chromatography (silica gel 60) using first toluene as eluent, then 75–25 methylene chloride/hexane with a gradual increase to 100% methylene chloride. A yield of 1.21 g (25%) of essentially pure carbamate product was obtained. This product was crystallized from chloroform to give 0.97 g of white crystals, mp 84.5°–86° C. NMR (acetone) δ5.95(s), 5.24(d); IR (KBr): 1740 (c=o) $cm^{-3}$.

Anal. Calcd for $C_7H_6N_8F_2O_{16}$: C, 16.94; H. 1.22; N, 22.58; F, 7.66. Found: C, 16.95; H, 1.16; N, 22.35; F, 7.70.

EXAMPLE 5

Preparation of N,N-bis(2-fluoro-2,2-dinitroethyl)urea (V)

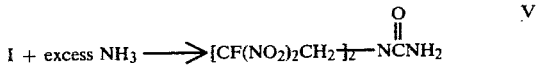

V

A solution of 4.0 g of N,N-bis(2-fluoro-2,2-dinitroethyl)carbamyl chloride in 30 ml of ether was stirred in an ice bath while ammonia gas was quickly passed into the solution until it remained slightly basic to damp pH paper and a reddish tint to the solution persisted. Water (30 ml) was added and the ether layer was separated, dried with magnesium sulfate and concentrated by distillation. Chloroform was then slowly added until the distillate temperature reached 60° C. and crystals formed from hot solution. Cooling in the refrigerator gave 3.14 g (83.5%) of crystals, mp 119°–121° C. Recrystallization from ether-chloroform gave mp 120°–122° C. NMR (acetone): δ6.36(s), 5.08(d); IR (KBr): 3490, 3390($NH_2$), 1665 (c=o) $cm^{-1}$.

Anal. Calcd for $C_5H_6N_6F_2O_9$: C, 18.08; H, 1.82; N, 25.30; F, 11.44. Found: C, 18.19; H, 1.86; N, 25.05: F, 11.42.

EXAMPLE 6

Preparation of [N,N-bis(2-fluoro-2,2-dinitroethyl)carbamyl]hydrazine (VI)

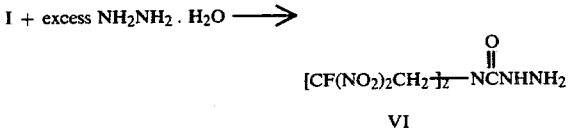

VI

A mixture of 3.2 g of hydrazine hydrate (85% solution) and 20 ml of ethyl ether was stirred rapidly at −15° C. while a solution of 4.0 g of N,N-bis(2-fluoro-2,2-dinitroethyl)carbamyl chloride in 20 ml of ethyl ether was added in two portions. After 5 minutes 40 ml of cold water was added and the ether layer was separated and dried with magnesium sulfate. The ether was allowed to evaporate to give 3.63 g (90%) of white solid, mp 100°–101° C. dec. Crystallization from methylene chloride gave mp 102°–104° C. dec. NMR (methanol): δ4.93(d), 4.75(s). IR (KBr): 3330 (broad), 1650 (c=o).

Anal. Calcd for $C_5H_7N_7F_2O_9$: C, 17.30; H, 2.03; N, 28.24; F, 10.94. Found: C, 17.40; H, 2.07; N, 27.94; F, 11.09.

EXAMPLE 7

Preparation of 1,2-di[N,N-bis(2-fluoro-2,2-dinitroethyl)carbamyl]hydrazine (VII)

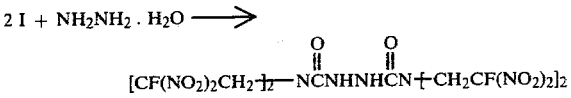

VII

A solution of 8.0 g of N,N-bis(2-fluoro-2,2-dinitroethyl)carbamyl chloride in 40 ml of ethyl ether was rapidly stirred in a water bath at 25° C. while 2.7 g of hydrazine hydrate (85% solution) was added dropwise over a 35 minute period. After 10 minutes cold water (50 ml) was added and the ether layer was separated, dried with magnesium sulfate, and concentrated to 25 ml by distillation. Chloroform was slowly added until the distillate temperature reached 60° C. and a large amount of solid had precipitated. Cooling to room temperature gave 4.85 g of solid, mp 180–185*. Digestion of the solid with boiling methylene chloride gave 4.23 g (56%) of white solid, mp 195°–197° C. dec. The melting point was raised to 200°–201° C. dec. by shaking an ether solution of the solid with conc. hydrochloric acid, then washing with water, concentrating by distillation, and adding chloroform. NMR (acetone): δ8.70(s), 5.18(d); IR (KBr): 3330 (NH), 1650 (c=o) $cm^{-1}$.

*1.47 g (19%) of [N,N-bis(2-fluoro-2,2-dinitroethyl)carbamyl]hydrazine, mp 101°–102° C. dec., was recovered from the mother liquor Anal. calcd for $C_{10}H_{10}F_4N_{12}O_{18}$: C, 18.14; H, 1.52; N, 25.38; F, 11.48; mol. wt. 662. 27. Found: C, 18.39; H, 1.40; N, 25.16; F, 11.38; mol. wt. 661.

The di-substituted hydrazine (VII) was also prepared in 83% yield by treating the carbamyl chloride (I) with the mono-substituted hydrazine (VI) in ether solution (pyridine as proton acceptor). The product precipitates as a pyridine complex which can be broken up by stirring with a mixture of conc. hydrochloric acid and ether.

EXAMPLE 8

Preparation of N,N,N',N'-tetrakis(2-fluoro-2,2-dinitroethyl)biuret (VIII)

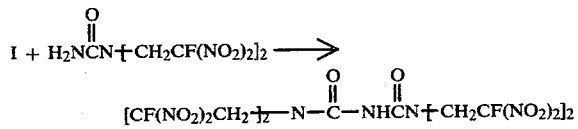

VIII

To a solution of 0.40 g (0.005 mol) of pyridine in 15 ml of methylene chloride was added 0.66 g (0.002 mol) of N,N-bis(2-fluoro-2,2-dinitroethyl)urea (V) followed by 1.40 g (0.004 mol) of N,N-bis(2-fluoro-2,2-dinitroethyl)carbamyl chloride. The mixture was stirred for a few minutes to dissolve all material and then allowed to stand for 18 hours before the dark colored solution was decanted from a small amount of dark insoluble material. The solution was extracted with 20 ml of 10% hydrochloric acid after which crystals slowly began to precipitate from the solution which was then cooled to 5° C. to complete the crystallization. The dark colored crystals (0.68 g, mp 125°–130° C.) were crystallized from methanol-water (charcoal) to give 0.42 g (33%) of white crystals, mp 140°–143° C. Recrystallization from methylene chloride raised the melting point to 142°–144° C. NMR (acetone): δ5.27 (broad multiplet), 2.70 (s). IR (KBr): 3450 (NH, broad), 1795, 1735 (c=o) $cm^{-1}$. Mass spectrum (C.I.): (m/e) 649(M+2).

Anal. calcd. for $C_{10}H_9N_{11}F_4O_{18}$: C, 1856; H, 1.40; N, 23.80; F, 11.74; mol. wt. 647.26. Found: C, 18.65; H, 1.47; N, 23.93; F, 11.70; mol wt. 656.

The initial derivatives prepared from I can also be useful intermediates for the synthesis of other explosive materials. For example [N,N-bis(2-fluoro-2,2-dinitroethyl)carbamyl]hydrazine (VI) was added to fluorodinitroacetonitrile to give 1-[N,N-bis(2-fluoro-2,2-dinitroethyl)carbamyl]-2-(2-fluoro-2,2-dinitroethylimino)hydrazine (IX). Compound IX was hydrolyzed to give 1-[N,N-bis(2-fluoro-2,2-dinitroethyl)carbamyl]-2-fluorodinitroacetyl hydrazine (X) and cyclized with trifluoroacetic anhydride to yield trifluoroacetyl-3-[bis(2-fluoro-2,2-dinitroethyl)amino]-5-fluorodinitromethyl-1,2,4-triazole (XI).

EXAMPLE 9

Preparation of 1-[N,N-bis(2-fluoro-2,2-dinitroethyl)carbamyl]-2-(2-fluoro-2,2-dinitroethylimidoyl)hydrazine (IX)

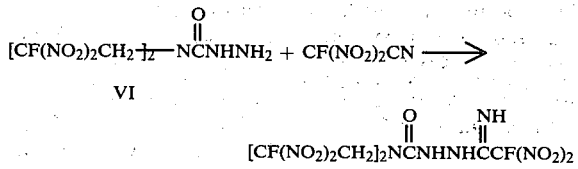

To a solution of 2.0 g of fluorodinitroacetonitrile in 4.5 ml of methylene chloride was added 1.0 g of [N,N-bis(2-fluoro-2,2-dinitroethyl)carbamyl]hydrazine in 10 portions with stirring to dissolve each portion. Crystals began to precipitate within 15 min. and after standing overnight, the crystals were removed by filtration and washed with cold methylene chloride*. The cream colored crystals (1.23 g, 86%) had mp 109°–110° C. dec. Crystallization from ethyl ether-methylene chloride did not raise the melting point. NMR (acetone): δ8.95 (broad s), 6.89 (broad s), 5.25 (d), 2.96 (broad s). IR (KBr): 3450, 3340, 3210 (NH), 1675 (c=o) $cm^{-1}$.

*The methylene chloride wash was kept separate from the mother liquor. To the mother liquor was added 0.5 ml of methylene chloride followed by 0.80 g of [N,N-bis(2-fluoro-2,2-dinitroethyl)carbamyl]hydrazine in the manner described above. An additional 0.90 g of product, mp 108–109 dec. was obtained.

Anal. calcd for $C_7H_7N_{10}F_3O_{13}$: C, 16.94; H, 1.42; N, 28.23; F, 11.49. Found: C, 17.14; H, 1.35; N, 28.15; F, 11.65.

EXAMPLE 10

Preparation of 1-[N,N-bis(2-fluoro-2,2-dinitroethyl)carbamyl]-2-(2-fluoro-2,2-dinitroacetyl)hydrazine (X)

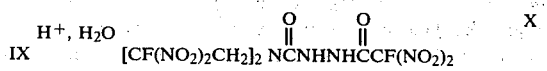

A mixture of 0.70 g of 1-[N,N-bis(2-fluoro-2,2-dinitroethyl)carbamyl]-2-(2-fluoro-2,2-dinitroethylimidoyl)hydrazine and 10 ml of conc. hydrochloric acid was stirred at ambient temperature. After 10 min. all material was dissolved and the solution was allowed to stand overnight at which time it was diluted with 30 ml of water and extracted with ether. Removal of the ether gave 0.68 g of oil which was crystallized from methylene chloride-chloroform to give a first crop (0.23 g, mp 138°–140° C.) and a second crop (0.14 g, mp 128°–132° C.) [53% yield]. Recrystallization of the first crop from methylene chloride raised the melting point to 140°–141° C. NMR (acetone): δ10.95 (broad s), 9.36 (s), 5.22 (d); IR (KBr): 3350, 3200 (NH), 1745, 1670 (c=o) $cm^{-1}$.

Anal. Calcd for $C_7H_6N_9F_3O_{14}$: C, 1691; H, 1.22; N, 25.36; F, 11.46. Found: C, 16.85; H, 1.14; N, 25.12; F, 11.46.

EXAMPLE 11

Preparation of a mixture of the isomers 1-, 2-, and 4-trifluoroacetyl-3-[bis(2-fluoro-2,2-dinitroethyl-)amino]-5-fluorodinitromethyl-1,2,4-triazole (IX)

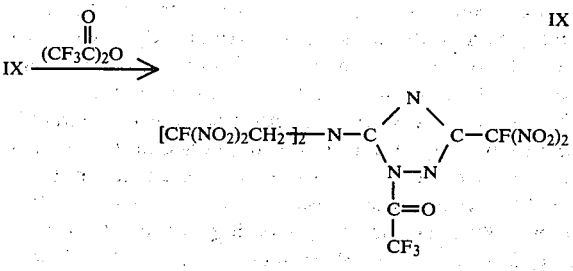

A mixture of 1.12 g of 1-[N,N-bis(2-fluoro-2,2-dinitroethyl)carbamyl]-2-(2-fluoro-2,2-dinitroethylimino)-hydrazine and 10 ml of trifluoroacetic anhydride was stirred at ambient temperature for 48 hr. (all material was dissolved after several hours). The volatiles were removed with a stream of nitrogen and gentle heating (30°–35° C.) to give an oily residue which was dried in a vacuum desiccator over potassium hydroxide to a constant weight of 1.31 g (theoretical yield=1.30 g). The oil is sensitive to atmospheric moisture at its IR spectrum changes if the oil stands unprotected from moisture. The oil appears to be a mixture of the isomers 1-trifluoroacetyl-3-[bis(2-fluoro-2,2-dinitroethyl-)amino]-5-fluorodinitromethyl-1,2,4-triazole, 2-trifluoroacetyl-3-[bis(2-fluoro-2,2-dinitroethyl)amino]-5-fluorodinitromethyl-1,2,4-triazole, and 4-trifluoroacetyl-3-[bis(2-fluoro-2,2-dinitroethyl)amino]-5-fluorodinitromethyl-1,2,4-triazole; attempts to crystallize it were not successful. The NMR spectrum (chloroform) of the oil shows a large doublet at 5.16 ppm along with much smaller doublets at 4.80 and 4.08 ppm. A small peak which appears to be a broad singlet (5.55 ppm) is also present. IR (film on NaCl plates): no NH absorption, 1760 (c=o), 1600 ($NO_2$), 1200 ($CF_3$) $cm^{-1}$. Mass spectrum (C.K.): (m/e) 575 (M+1).

Obviously, numerous modifications and variations of the present invention are possible in light of the above teachings. It is therefore to be understood that within the scope of the appended claims the invention may be practiced otherwise than as specfically described herein.

What is claimed as new and desired to be secured by Letters Patent of the United States is:

1. A thiolcarbamate of the formula $$[(NO_2)_2FCCH_2]_2\,NC(=O)-SR$$

wherein R is selected from the group consisting of methyl, ethyl, and n-propyl.

2. The thiolcarbamate of claim 1 which is S-methyl N,N-bis(2-fluoro-2,2-dinitroethyl)thiolcarbamate.

3. The thiolcarbamate of claim 1 which is S-ethyl N,N-bis(2-fluoro-2,2-dinitroethyl)thiolcarbamate.

4. The thiolcarbamate of claim 1 which is S-propyl N,N-bis(2-fluoro-2,2-dinitroethyl)thiolcarbamate.

* * * * *